US011627845B2

(12) United States Patent
Vail et al.

(10) Patent No.: US 11,627,845 B2
(45) Date of Patent: Apr. 18, 2023

(54) WIPES DISPENSERS HAVING MULTIPLE WIPE CONTACT POINTS

(71) Applicant: GOJO Industries, Inc., Akron, OH (US)

(72) Inventors: Kevin Michael Vail, North Royalton, OH (US); Christopher James Mann, Hudson, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 16/851,754

(22) Filed: Apr. 17, 2020

(65) Prior Publication Data

US 2020/0329926 A1 Oct. 22, 2020

Related U.S. Application Data

(60) Provisional application No. 62/835,612, filed on Apr. 18, 2019.

(51) Int. Cl.

| | |
|---|---|
| ***A47K 10/38*** | (2006.01) |
| ***A47K 10/42*** | (2006.01) |
| *A47K 10/32* | (2006.01) |

(52) U.S. Cl.

CPC ..... *A47K 10/421* (2013.01); *A47K 10/38* (2013.01); *A47K 2010/3266* (2013.01)

(58) Field of Classification Search

CPC ..... A47K 10/3818; A47K 2010/3206; A47K 2010/3233; A47K 2010/3246; Y10T 225/393

(Continued)

(56) References Cited

U.S. PATENT DOCUMENTS 9,113,759 B2 8/2015 Ray et al.
10,849,470 B2 * 12/2020 Mann ..... B65D 83/0805

(Continued)

FOREIGN PATENT DOCUMENTS

EP 2220984 A2 8/2010
GB 2002327 A 2/1979

OTHER PUBLICATIONS

International Search Report and Written Opinion from PCT/US2020/028824 dated Jul. 22, 2020.

*Primary Examiner* — Gene O Crawford
*Assistant Examiner* — Ayodeji T Ojofeitimi
(74) *Attorney, Agent, or Firm* — Calfee, Halter & Griswold LLP

(57) ABSTRACT

Embodiments of dispensers for dispensing wet wipes are disclosed herein. An exemplary wipes dispenser includes a container, having an opening, a cap, and a first wipe engagement member. The first wipes engagement member includes an opening therethrough. The first wipes engagement member is configured to provide sufficient force on a wipe to prevent the wipe from falling back into the container. A second wipes engagement member is also included. The second wipes engagement member located away from the first wipes engagement member. The second wipes engagement member includes a pull through portion and a grip portion. An access point is located between the first wipes engagement member and the second wipes engagement member. The access point configured to allow a user to grip a lead edge of a wipe as the wipe is threaded through the first wipes engagement member.

12 Claims, 9 Drawing Sheets

(58) Field of Classification Search
USPC ..... 221/33–63
See application file for complete search history.

(56) References Cited

U.S. PATENT DOCUMENTS

| | | | | |
|---|---|---|---|---|
| 2006/0261076 | A1* | 11/2006 | Anderson | A47K 10/3818 221/33 |
| 2010/0206896 | A1* | 8/2010 | Ray | A47K 10/3818 221/45 |
| 2013/0306669 | A1* | 11/2013 | Ray | B65D 83/0805 221/63 |
| 2015/0048105 | A1* | 2/2015 | Gordon | B65D 83/0805 221/63 |

* cited by examiner

WIPES DISPENSERS HAVING MULTIPLE WIPE CONTACT POINTS

RELATED APPLICATIONS

The application claims priority to, and the benefits of, U.S. Provisional Patent Application Ser. No. 62/835,612, titled WIPES DISPENSERS HAVING MULTIPLE WIPE CONTACT POINTS, which was filed on Apr. 18, 2019 and which is incorporated herein by reference in its entirety.

TECHNICAL FIELD

The present invention generally relates to dispensers for dispensing wipes or moist towelettes. More particularly, the present invention relates to wipes dispensers having a first wipe contact point and a second wipe contact point.

BACKGROUND OF THE INVENTION

Wipes are typically made from a variety of materials, such as non-woven materials. Wipes are often moistened with solutions, such as antimicrobial solutions. The wipes may be stacked and folded in a container or may be in the form of a roll. Wipes in the form of a roll typically have a lines of perforations between the wipes that are strong enough for the wipes to remain attached to one another so that the top of the trailing is pulled up through the outlet nozzle prior to the perforations tearing away allowing the leading wipe to separate for use. Hopefully, this results in a lead tail extending out of the outlet nozzle a sufficient length so that the lead tail of the trailing wipe may be grabbed by a user and pulled out of the container. Often, however, the lead tail does not extend high enough past the opening in the nozzle for a user to grab, which leads to customer "short tail" complaints. Similarly, "fall back" complaints occur when the trailing wipe falls back through the outlet nozzle and back into the container. In addition, it is often difficult to thread the wipes through the outlet nozzle and accordingly, it is often more than merely annoying when fall back occurs, when short tails occur, or when it is time to install a new roll of wipes the dispenser. Furthermore, some of the current wipe nozzles require a tool to rethread the wipes up through the outlet nozzle. In addition, when a container of wipes sits for an extended period of time, "dry-out" may occur, wherein the fluid used to wet the wipes evaporates out of the container.

SUMMARY

Embodiments of dispensers for dispensing wet wipes are disclosed herein. An exemplary wipes dispenser includes a container, having an opening, a cap, and a first wipe engagement member. The first wipes engagement member includes an opening therethrough. The first wipes engagement member is made of an elastomeric member and is configured to provide sufficient force on a wipe to prevent the wipe from falling back into the container. A second wipes engagement member is also included. The second wipes engagement member located away from the first wipes engagement member. The second wipes engagement member includes a pull through portion and a grip portion. The second wipes engagement member is made of a more rigid material than the first engagement member. In some embodiments, an access point is located between the first wipes engagement member and the second wipes engagement member. The access point is configured to allow a user to grip a lead edge of a wipe as the wipe is threaded through the first wipes engagement member.

Another exemplary wipes dispenser includes a container, the container having a surface, which may be a cap on the container. A first wipe engagement member is located in the surface. The first wipes engagement member is an elastomeric engagement member located in the surface. The elastomeric engagement member has an opening therethrough. The wipes dispenser further includes a second wipe engagement member. The second engagement member is located away from the first engagement member, and the second engagement member is more rigid than the first engagement member. Some exemplary embodiments do not include a container. In, some exemplary embodiments, the surface is a cap. In some embodiments the cap is secured to a container.

Another exemplary wipes dispenser includes a container, the container having a surface, which may be a cap on the container. A first wipe engagement member is located in the surface. The first wipes engagement member is an elastomeric engagement member located in the surface. The elastomeric engagement member has an opening therethrough. The wipes dispenser further includes a second wipe engagement member. The second engagement member is located away from the first engagement member, and the second engagement member is made of a different material than the first engagement member. Some exemplary embodiments do not include a container. In, some exemplary embodiments, the surface is a cap. In some embodiments the cap is secured to a container.

Another exemplary wipes dispenser includes a container. The container has a surface, which may be a cap. A first wipes engagement member located in the surface. The first wipes engagement member contacting a wipe in a first position. The first wipes engagement member being made of a first material. A second wipes engagement member on the container. The second wipes engagement member contacting the wipe in a second position. The second wipes engagement member is made of a second material, wherein the second material is more rigid than the first material.

Another exemplary embodiment of a wipes dispenser includes a container that has an opening in the container. A fall back preventing member is located proximate the opening. The fall back prevention member composed of a first material. The fall back prevention member has a circular opening. In some embodiments, the opening is non-circular, such as, for example, an ellipse, a slit, or the like. A grip member is included and is located away from the fall back preventing member. The grip member is made of a second material that is more rigid then the first material and wherein the grip member contacts wipes and is configured to grip the wipes with sufficient force that a first wipe connected to a second wipe along a perforation line will separate from the second wipe when the grip member engages the second wipe.

BRIEF DESCRIPTION OF THE DRAWINGS

These and other features and advantages of the present invention will become better understood with regard to the following description, and accompanying drawings where.

DETAILED DESCRIPTION

Figure 1:
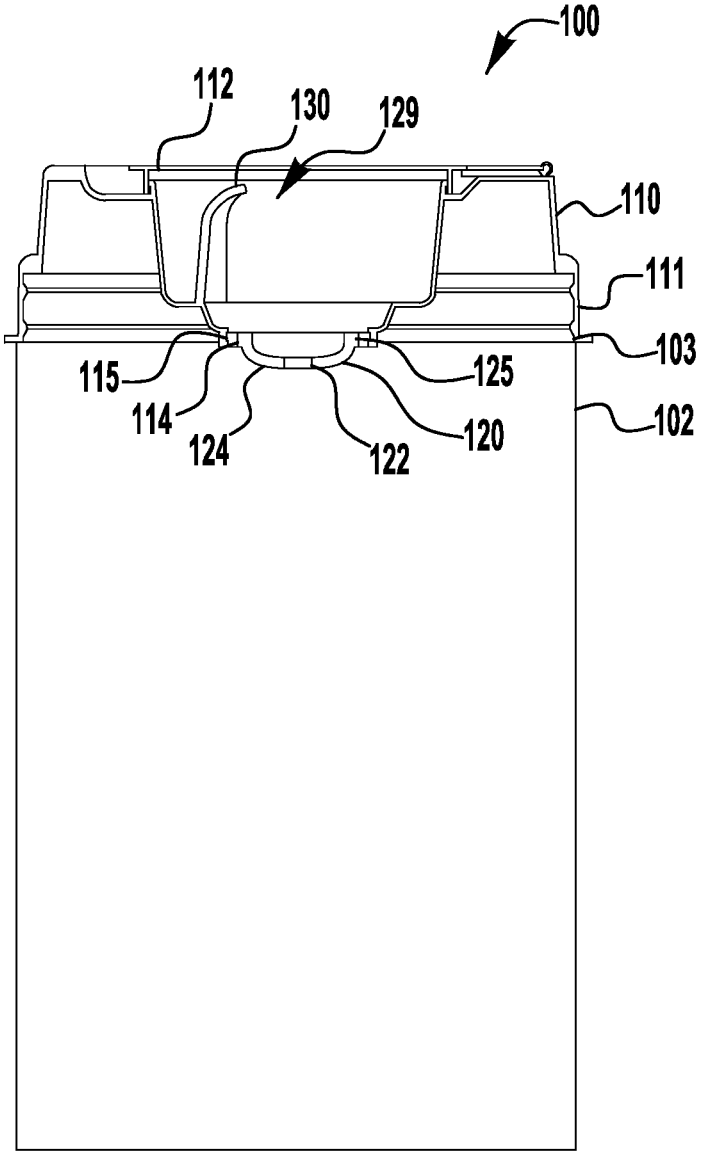
FIG. 1 is cross-section of an exemplary embodiment of a wipes dispenser having two wipes contact points.

FIG. 1 is cross-section of an exemplary embodiment of a wipes dispenser 100. Wipes dispenser 100 includes a container 102 having an opening 103 at the top of the container.

Although the embodiments shown and described herein, illustrate an opening at the top of the container, the opening may be located in other locations, such as, for example, a side of the container, or the bottom of the container. Accordingly, features and structures described below may also be located on the side of the container and/or on the bottom of the container. A cap 110 is secured to opening 103 by closure 111. Closure 111 may be joined to container 102 by any means, such as, for example, a snap-fit connection, threading and the like. In some embodiments, a cap is not required and one or more of the components described herein are connected to a surface of the container proximate an opening in the container. In this exemplary embodiment, cap 110 includes an opening 114.

Opening 114 includes an annular groove 115 which is configured to retain first wipes engagement member 120 (which may be referred to as first wipes contact member). In this exemplary embodiment, first wipes engagement member 120 is made of a resilient material. In some embodiments, the resilient member is an elastomer. Components described herein, such as, for example, the resilient member, first wipes engagement member, first wipes contact points, or fall back preventers and the like may be made of any type of flexible resilient material that is capable of performing the functions described herein, such as, for example, plastic, rubber, elastomer, silicone, urethane, and the like; and combinations thereof.

In this exemplary embodiment, first wipes engagement or contact member 120 is a made of resilient material that may include silicone. First wipes engagement member 120 has an opening 122 located therethrough. In this exemplary embodiment, opening 122 is a circular opening, however, in some embodiments, opening 122 has a different shape, such as, for example, an ovular shape, a star shape, an octagonal shape, or the like. In some embodiments, first wipes contact member 120 is configured such that the opening 122 stretches. In this exemplary embodiment, opening 122 is configured to be "stretchy" or elastic enough so that when a user is threading a wipe up through opening 122, opening 122 readily stretches allowing the user's finger to push up through the opening 122 and returns to its unstretched position. Accordingly, the opening 122 may be threaded without a tool. Opening 122 is configured to contact a wipe (not shown) and apply enough pressure on the wipe to hold the wipe in position and prevent the wipe from falling back into the container due to gravitational forces. First wipe engagement member 120 provides a first contact point on a wipe as it is pulled out of the dispenser 100.

In addition, in this exemplary embodiment, first wipes engagement member 120 is configured to provide a seal around a wipe (not shown) such that evaporation of fluid in the wipes container is reduced, and in some embodiments, partially eliminated, and in some embodiments, mostly eliminated and in one embodiments, substantially eliminated. In addition, in this exemplary embodiment, first wipes engagement member 120 has a concave or inverted dome shape. In this exemplary embodiment, the inverted dome shape has an apex 124 and a base 125. In this exemplary embodiment, apex 124 is located below base 125. In this exemplary embodiment, fluid (not shown) that is squeezed out of a wipe (not shown) may collect in the inverted dome of first wipes engagement member 120 and helps rewet the trailing portion of the wipe as it moves past. In addition, in some embodiments, fluid collected in the dome of first wipes engagement member 120 wicks up the leading edge of a wipe (not shown) while the wipe is held by first wipes engagement member 120 resulting in the lead edge of the wipe remaining wetted with fluid for a longer period of time.

In some embodiments, apex 124 is located above base 125. As described above, first wipes engagement member 120 is configured to apply sufficient pressure to a wipe to hold the wipe in place and prevent "fall-back" of the wipe after a lead wipe is torn off of the wipe that is partially though the opening 122 of first engagement member 120.

Cap 110 contains a second wipes engagement member 129. In this embodiment, second wipes engagement member 129 is a grip member 130. Grip member 130 is made of a material, such as, for example, plastic, or polyvinyl chloride ("PVC"). Grip member 130 is more rigid than first wipes engagement member 120. In some embodiments, grip member 130 is made of a different material than first wipes contact member 120 to achieve a more rigid grip member 130. In some embodiments, the material is the same, however, the configuration of the grip member 130 renders it more rigid than the first wipes contact member. For example, grip member 130 may be thicker than first wipes contact member.

Grip member 130 is configured to provide a stronger force on a wipe as the wipe is pulled through grip member 130. Accordingly, when a lead wipe is connected to a trailing wipe by a perforation line, grip member 130 provides enough force to ensure that once the trailing wipe enters the grip member, the trailing wipe is separated from the lead wipe. In some embodiments, the lead edge of the trailing wipe remains in the grip member 130. In some embodiments, the lead edge of the trailing wipe does not remain in grip member 130 after the lead wipe separates from the trailing wipe.

Cap 110 includes an optional lid 112. In this exemplary embodiment, lid 112 is shown in a closed position.

Figure 2:
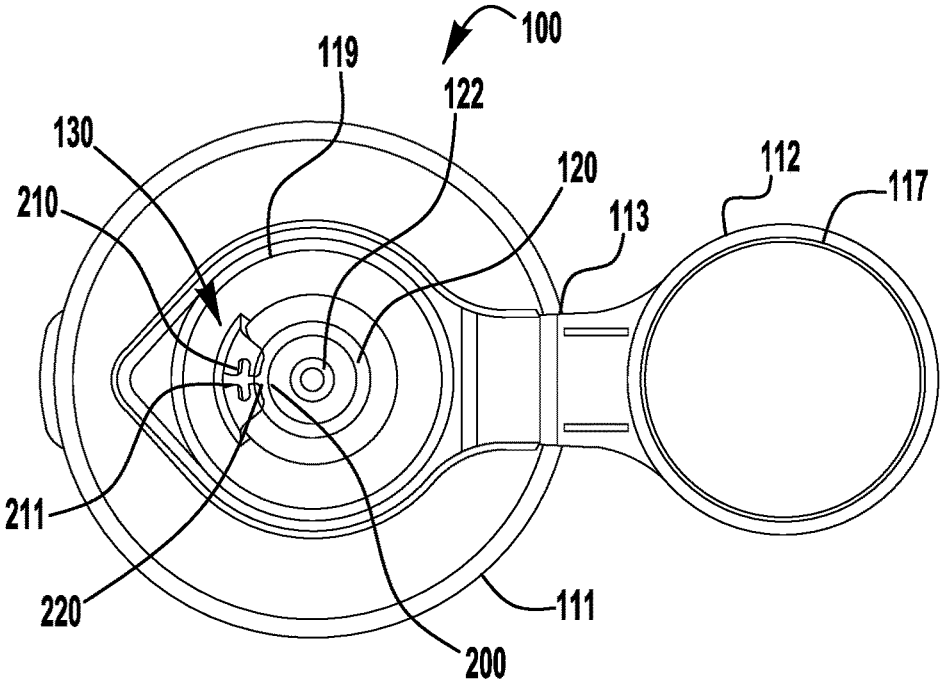
FIG. 2 is top view of the cap shown in FIG. 1.

FIG. 2 is top view of the cap 110 shown in FIG. 1. Grip member 130 includes an entry opening 200. Entry opening 200 allows a user to determine when to move the wipe (not shown) into grip member 130. Accordingly, if the user desires to take more than one wipe, the user need only pull the wipe (not shown) up and once a desired length, or number of wipes are extracted from the wipes dispenser, the user then moves the wipe through entry opening 200 into grip member 130 to separate the trailing wipe from the length of wipes. In this exemplary embodiment grip member 130 includes a plurality of flexible fingers 210. The flexible fingers 210 flex slightly allowing the wipe to be easily pulled past. In some embodiments, no flexible fingers are included and a simple slot may be used. In addition, in some embodiments, a grip slot 211 provides a portion of grip member 130 that has a reduced cross-sectional area. The grip slot 211 allows a user to pull a wipe (not shown) into the grip slot 211 to increase the force on the wipe to separate a leading wipe from a trailing wipe.

In this exemplary embodiment, grip member 130 is off-set from first wipes engagement member 130. In this exemplary embodiment, engagement member 130 is located in the center of the opening 103 in container 102 and grip member 130 is off-set from the center. In some embodiments, grip member 130 is located directly above first wipes engagement member 120. In this exemplary embodiment, grip member 130 is positioned so that fluid squeezed out of a wipe as it passes through grip member 130 flows into first resilient member 120 and, as described above, may help rewet, or wet the trailing portion of the wipe or leading edge of the trailing wipe. In this exemplary embodiment, cap 110 includes an optional lid 112. Lid 112 has a hinge portion 113 and has an annular projection 117 that mates with annular projection 119 in a friction fit connection to hold lid 112 in a closed position. In some embodiments, the annular projections 114 and/or 115 may include one or more ribs to aid in the friction fit connection.

Figure 3:
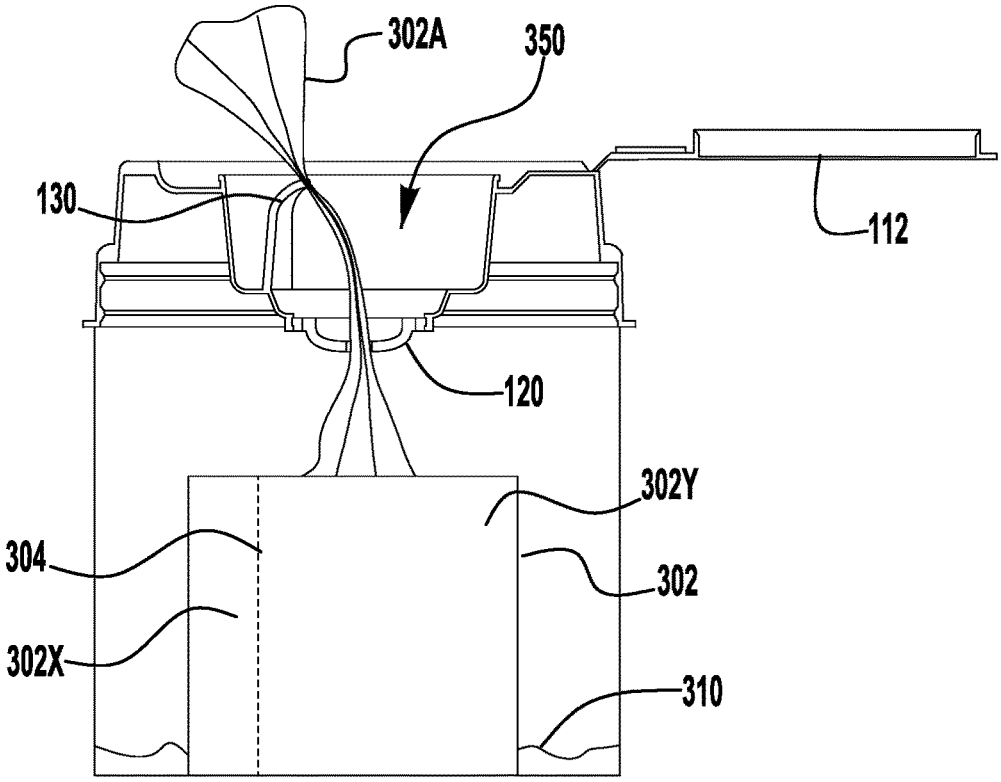
FIG. 3 is a cross-section of the dispenser with the lid open and a roll of wipes.

FIG. 3 is a cross-section of the dispenser 100 shown in FIG. 1 with the lid 112 open and a roll of wipes 302. Roll of wipes 302 includes a plurality of wipes, 302A, 302X, 302Y connected to one another by perforation lines, such as, for example, perforation line 304. Wipe 302A is pulled up through first wipes contact member 120 and is proximate opening 200 in grip member 130 and about to be pulled into grip member 130 to be separated from its trailing wipe (not shown).

As illustrated in FIG. 3, in some exemplary embodiments, there is an optional access point 350 or access area located between the top of the first wipes engagement member 120 and the second wipes engagement member or grip member 130. The access point 350 or area is configured to allow access to the top of the first engagement member 120. Thus, the access point 350 allows a user to grasp the lead edge of a wipe (not shown) as it is threaded up through firsts wipes engagement member 120. The access point 350 is an open area above the first wipes engagement member 120 that may be accessed from above the container cap 110.

The access point 350 or access area is open area between first engagement member 120 and second engagement area 129. In this exemplary embodiment, access point 350 is located in cap 110 above first wipes engagement member 120. In this exemplary embodiment, first wipes engagement member 120 is separated from second wipes engagement member or grip member 130 by an access point 350 or access area, which is an open area sufficiently sized to allow a user to reach the lead edge of a wipe as it is threaded through first wipes engagement member 120. In some embodiments, access point 350 or access area is accessible when lid 112 is open and inaccessible when lid 112 is closed.

Figure 4:
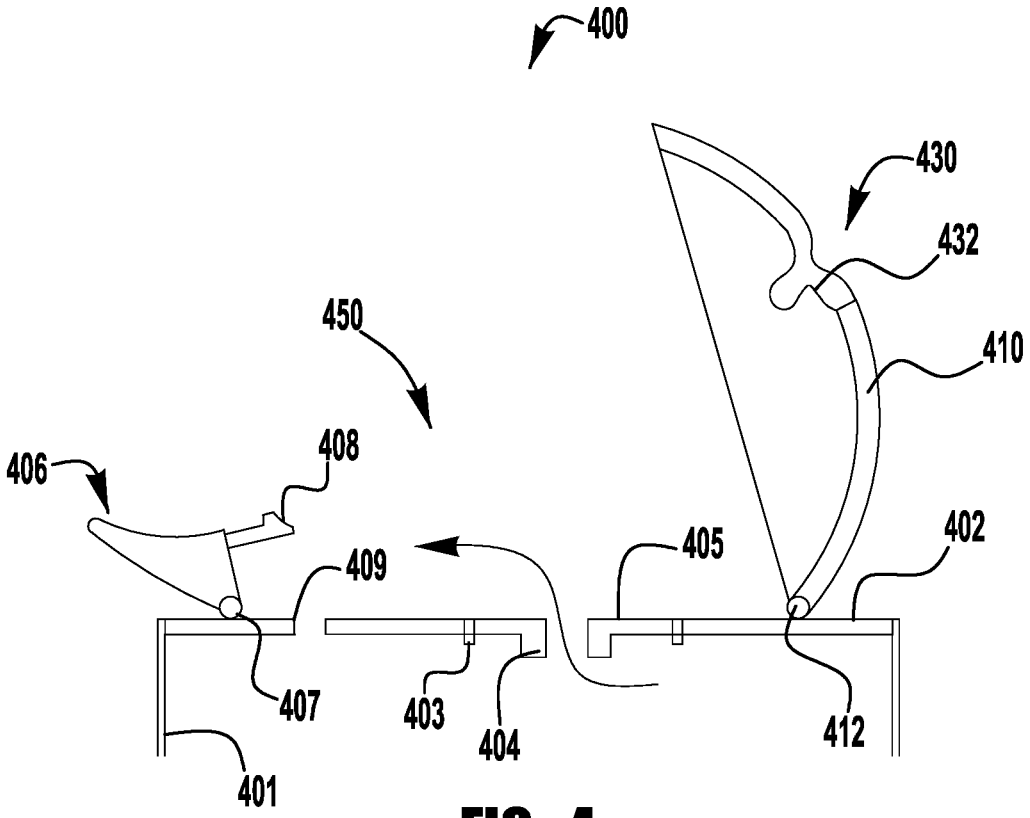
FIGS. 4 and 5 are cross-sections of another exemplary embodiment of a portion of a wipes dispenser having two wipes contact points.
Figure 5:
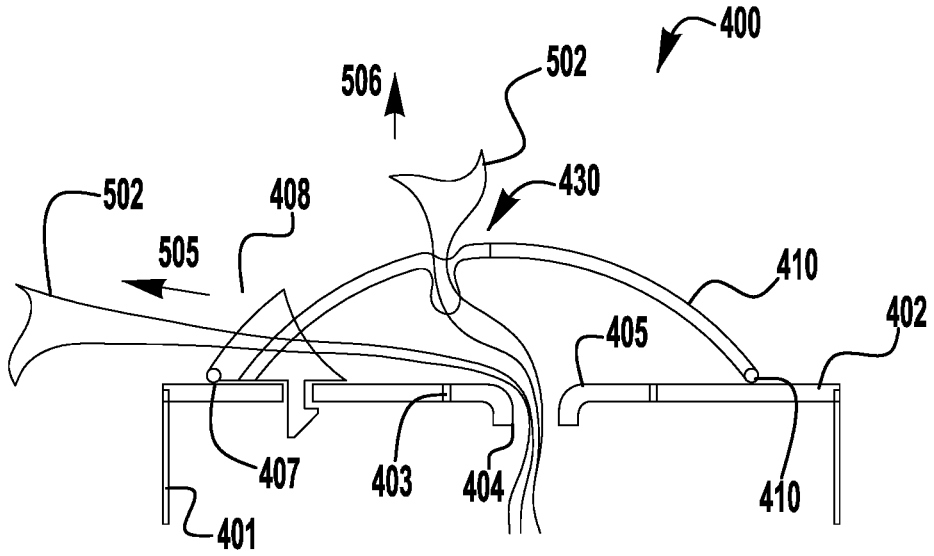

FIGS. 4 and 5 are cross-sections of a portion of another exemplary embodiment of a wipes dispenser 400 having two wipes contact points. Wipes dispenser 400 includes a container 401 that has a cap 402. Cap 402 includes a closable lid 410 that is secured to cap 402 by a hinge member 412. A lid release member 406 is included. Lid release member 406 has a connector 408 for releasably connecting to an aperture 409 in cap 402. When lid 410 is in the closed position, FIG. 5, lid release member 406 is rotated over and connector 408 fits into aperture 409 to secure the lid 410 in the closed position.

In this exemplary embodiment, cap 402 includes center portion 403. In some embodiments, center portion 403 is made of a different material than cap 402. Center portion 403 is a formed with a resilient member 405 that includes a first wipes engagement member 404. First wipes engagement member 404 engages a wipe 502 as the wipe is pulled therethrough. First wipes engagement member 404 has elastomeric properties and wipes engagement member 404 expands under force and contracts to return to its unbiased position. Wipes engagement member 404 exerts sufficient pressure on the wipe to hold the wipe in place and prevent the wipe from falling back into container 401. Preferably, a user threads a wipe through the wipe engagement member 404 by removing cap 402 from the container and pushing or threading a wipe through wipes engagement member 404 from underneath with the user's finger. In some embodiments, resilient portion 405 of first wipes engagement member is flexible enough so that a user may easily push their fingers through the first wipes engagement member 404, which will expand, to reach inside the container and grab a wipe 502 to initially thread the dispenser 400. In some embodiments, resilient portion 405 is a different material than the material surrounding resilient portion 405. In some embodiments, the resilient portion 405 is made of the same material as the surrounding material and or grip member 430, however, it may have different characteristics, such as, for example, thickness, that allows resilient portion 405 to readily flex allowing for easy threading of a wipe, while the surrounding portion and or the grip member 432 is more rigid, which may be accomplished by, for example, making the material thicker. Once the user removes their fingers or the tool, first wipes engagement member 404 contracts and engages wipe 502.

Figure 6:
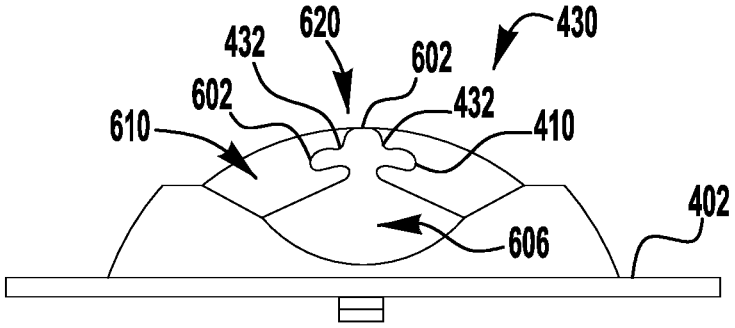
FIGS. 6 through 10 are schematic views of exemplary grip members.
Figure 7:
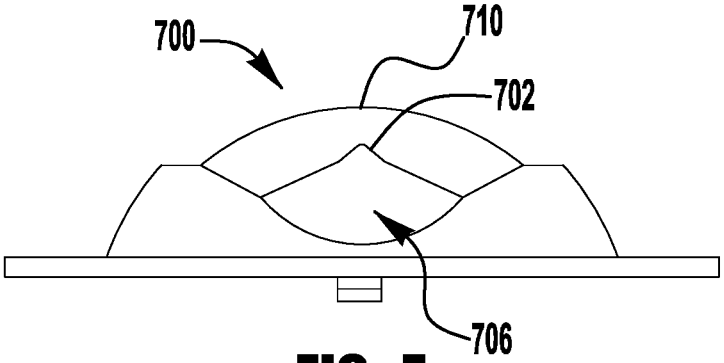
Figure 8:
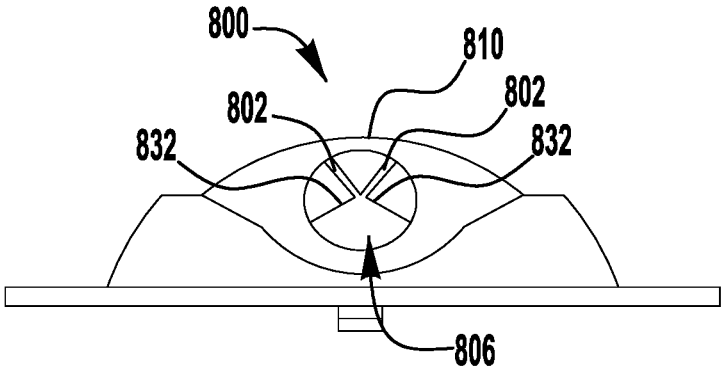
Figure 9:
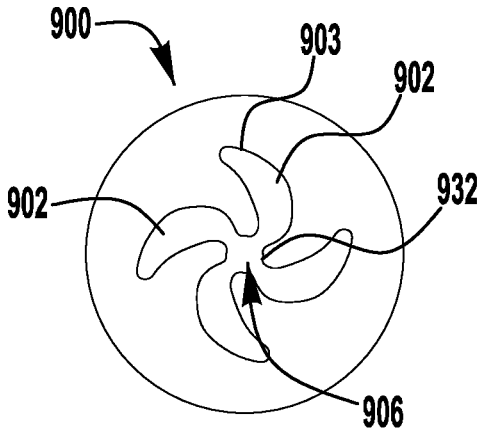
Figure 10:
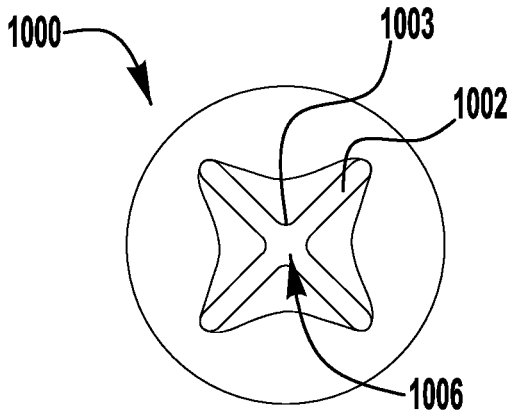

Wipes dispenser 400 includes a second wipe contact member 430. Second wipe contact member 430 is a grip member that grips wipe 502 when wipe 502 is pulled upward in direction 506. In this exemplary embodiment, second wipe contact member 430 includes an opening 606 (FIG. 6) forming a pull through portion 610. The pull through portion 610 allows a user to pull more than one wipe up through the lid 410 without separating the lead wipe from the trailing wipe. When a user has the desired length or number of wipes, the user simply pulls the wipe up in direction 506 so the wipes enter the second contact point 430 which grips the wipe and separates the trailing wipe from the lead wipe(s). In this exemplary embodiment the grip member, or second wipes engagement member 430 includes one or more slots 602 and one or more fingers 432. As the wipes 502 are pulled into the one or more slots 410 between the fingers 432, the friction on the wipe creates sufficient force to separate the lead wipe(s) from the trailing wipe. In this exemplary embodiment, fingers 432 may not provide sufficient force to separate the wipes, however, the one or more slots 410 does. In some embodiments, slots 410 are tapered and get smaller near their base. Although the second contact member 430, or grip member, is shown as being formed in lid 410, second contact member 430 may be formed in another portion of the cap 402 or as a stand-alone element.

As illustrated in FIG. 4, in some exemplary embodiments, there is an access point 450 or access area located between the top of the first wipes engagement member 404 and the second wipes engagement member 430. The access point 450 is an open area above the first wipes engagement member 404 that may be accessed from above the cap 402.

The access point 450 is configured to allow access to the top of the first engagement member 404. Thus, the access point 450 allows a user to grasp the lead edge of a wipe (not shown) as it is threaded up through firsts wipes engagement member 404. In this exemplary embodiment, access point 450 is located in cap 402 above first wipes engagement member 404 and below lid 410, when lid 410 is closed. In this exemplary embodiment, access point 450 is accessible when lid 410 is open. In some embodiments, access point 450 is accessible when lid 410 is open and inaccessible when lid 410 is closed.

FIGS. 7 through 10 are simplified views of exemplary grip members. Grip member 700 is formed in lid 710, however, grip member 700 may be a stand-alone element as described above, or may be formed in a portion of the cap that is not in the lid 710. Grip member 700 includes a pull through section 706 and gripper section 702. Similarly, grip member 800 includes a pull through section 806 and several slots 802 and fingers 832. In this exemplary embodiment, the fingers 832 are flexible, however, they provide sufficient friction with respect to the wipes to separate the wipes from one another. Grip member 900 includes a pull through section 906 and several slots 902 and fingers 932. In this exemplary embodiment, the fingers 932 are flexible, and do not provide sufficient friction with respect to the wipes to separate the wipes from one another. To separate the wipes from one another, the wipes are pulled into the ends 903 of slots 902 which do provide sufficient friction with respect to the wipes to separate the wipes from one another. Similarly, grip member 1000 includes a pull through section 1006 and several slots 1002 and fingers 1003. In this exemplary embodiment, the fingers 1032 are flexible, and do not provide sufficient friction with respect to the wipes to separate the wipes from one another. To separate the wipes from one another, the wipes are pulled into the ends 1003 of slots 1002 which do provide sufficient friction with respect to the wipes to separate the wipes from one another.

Figure 11:
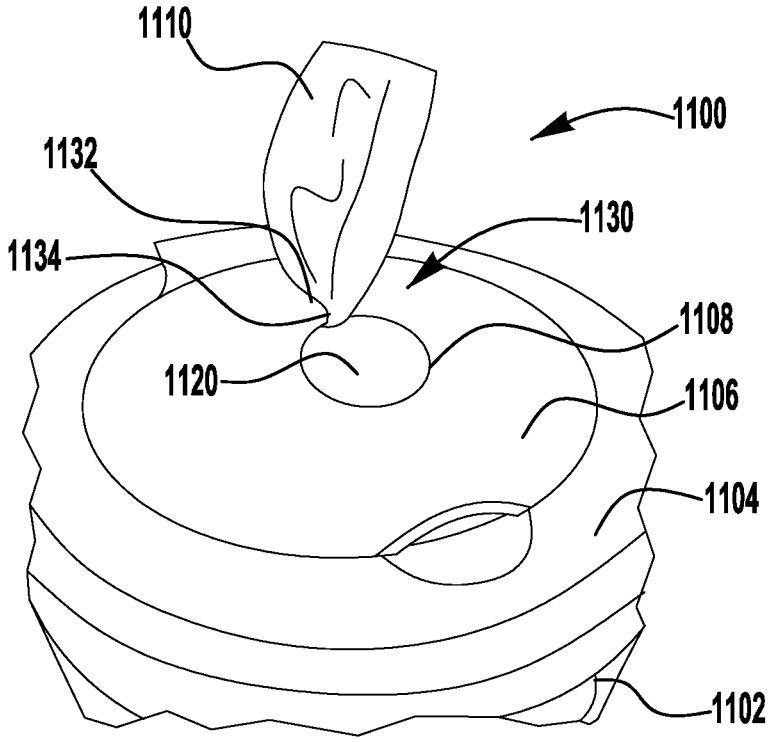
FIG. 11 is a prospective view of an exemplary embodiment of a wipes dispenser having two wipes contact points with a wipe extending upward therefrom.
Figure 12:
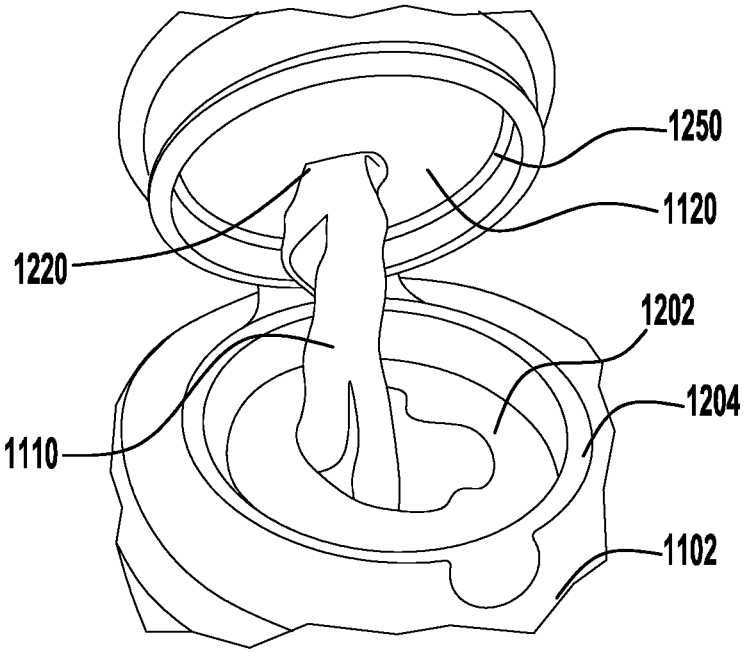
FIG. 12 is a prospective view of the exemplary dispenser of FIG. 11 with the cap removed.
Figure 13:
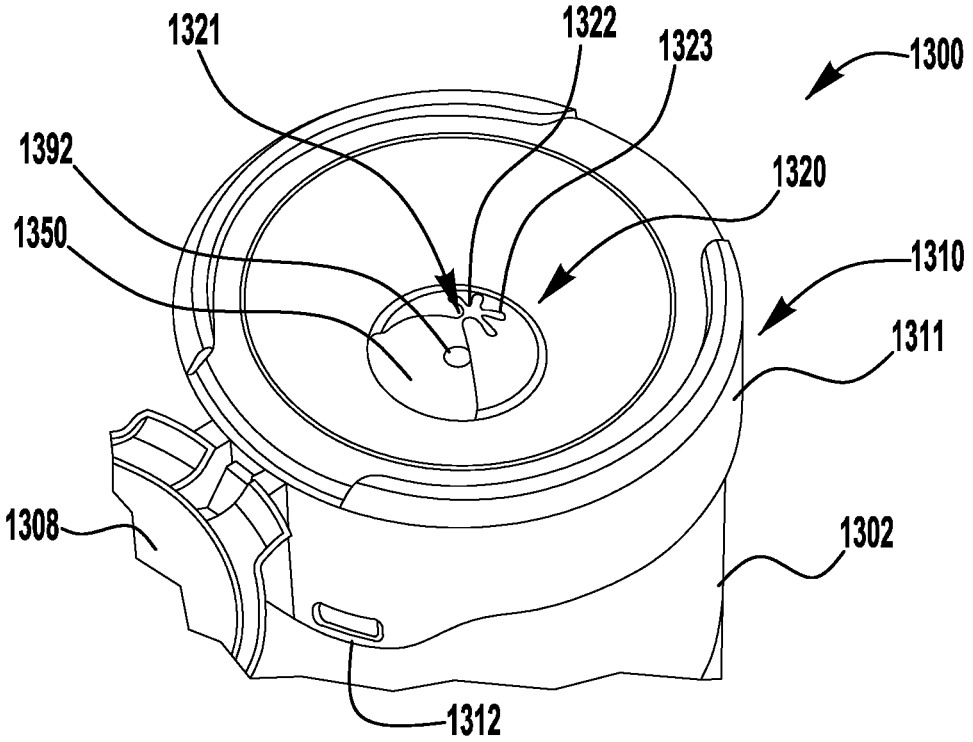
FIG. 13 is a partial prospective view of another exemplary dispenser having two wipes contact points.
Figure 14:
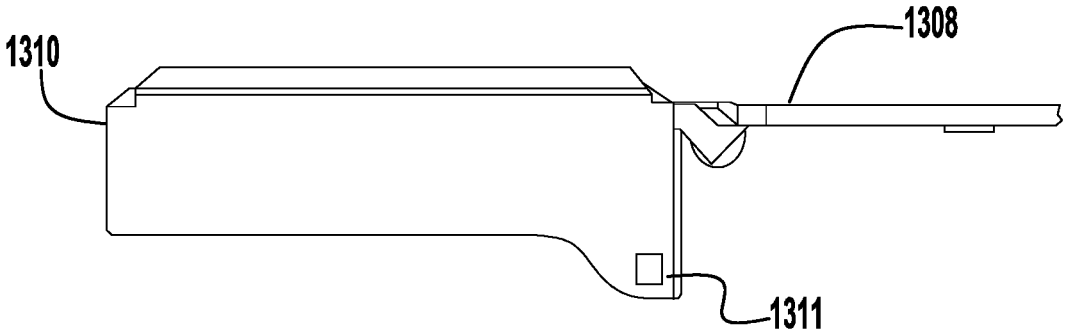
FIG. 14 is a partial side view of the cap of FIG. 13.
Figure 15:
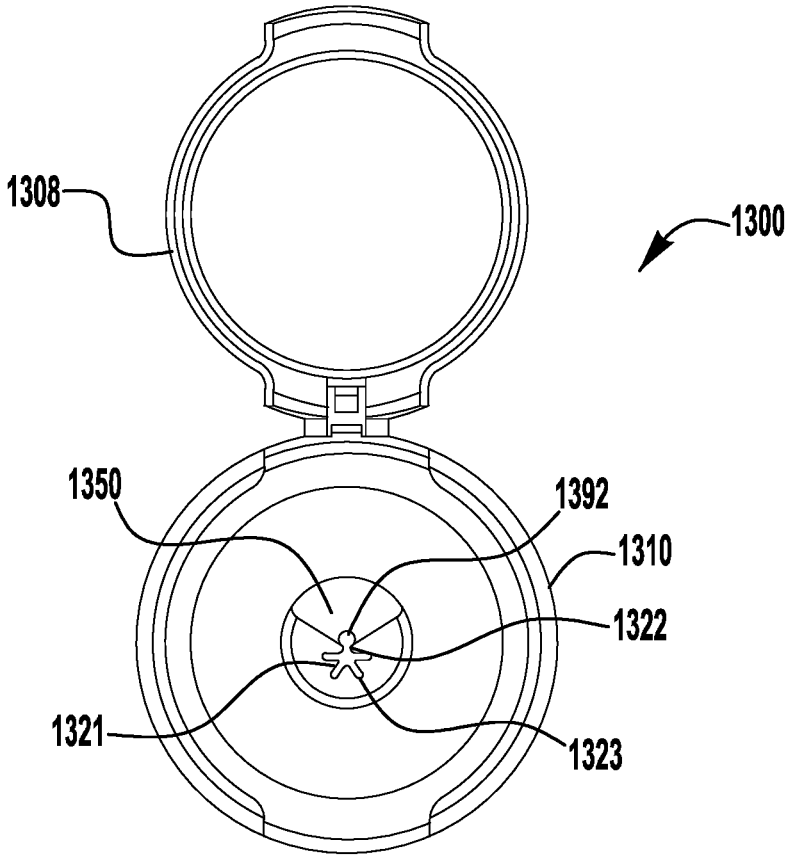
FIG. 15 is a top view of the cap of FIG. 13.
Figure 16:
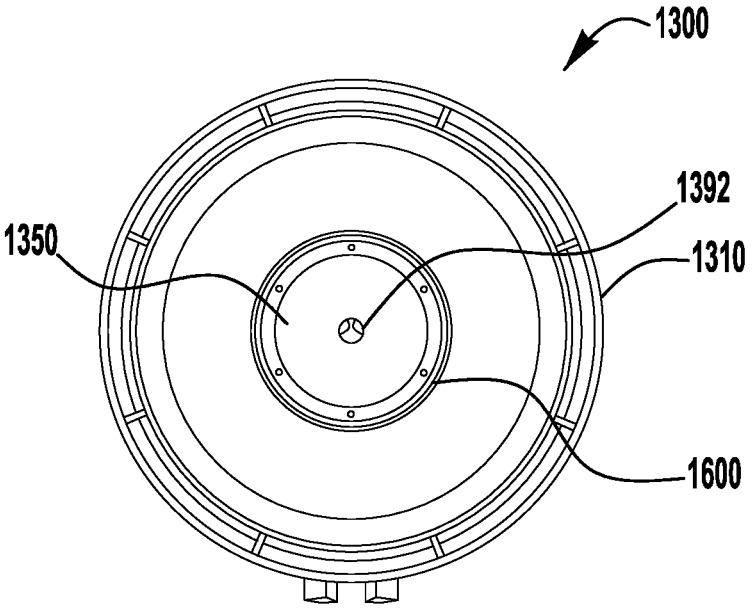
FIG. 16 is a bottom view of the cap of FIG. 13.
Figure 17:
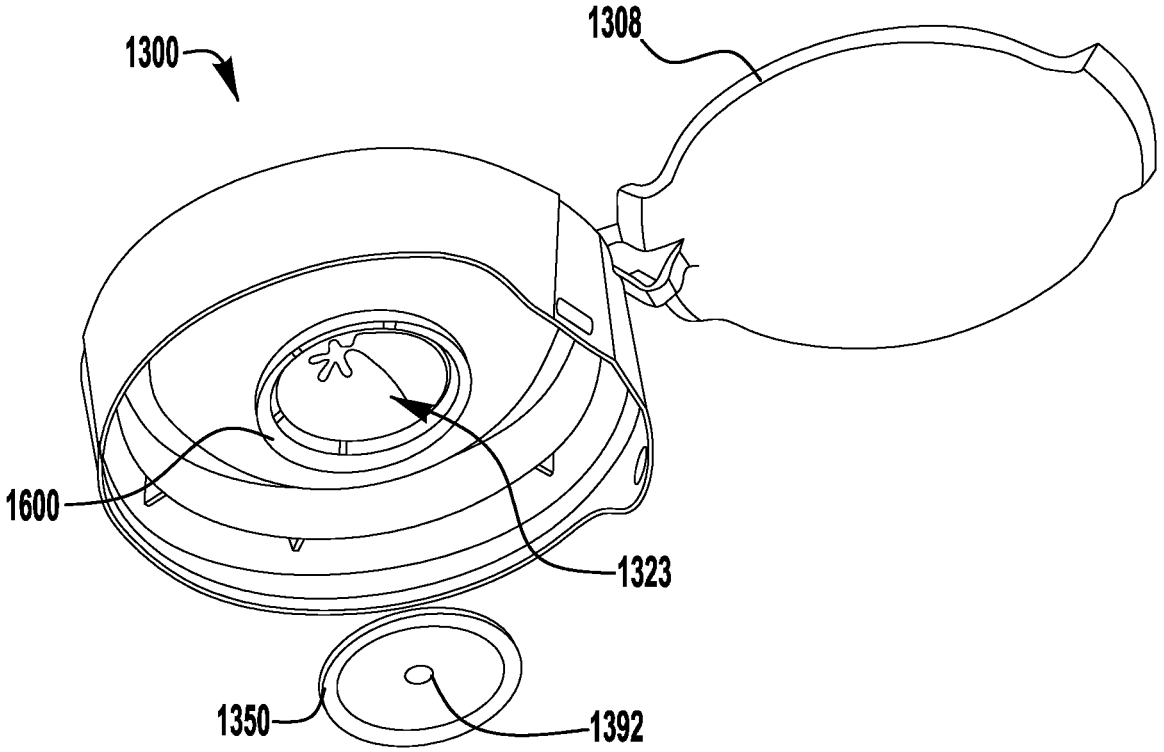
FIG. 17 is an exploded prospective view of the bottom of the cap of FIG. 13.

FIGS. 11 and 12 illustrate prospective views of another exemplary embodiment of a wipes dispenser 1100 having two wipes contact points. Wipes dispenser 1100 includes a container 1102, a cap 1104 secured to the container 1102 and a lid 1106 secured to the cap. The cap 1104 has a large aperture 1250 that is almost as wide as the opening 1204 in container 1102. A elastomeric membrane 1120 spans the aperture 1250. Elastomeric membrane 1120 has a small aperture 1220 therethrough. Aperture 1220 is a first wipes engagement member. Lid 1106 has a pull through aperture 1108 in the center and a grip member 1130 offset from the pull through aperture 1108. Grip member 1130 includes an opening 1134 and one or more slots 1132.

FIGS. 13-17 illustrate another exemplary embodiment of a wipes dispenser 1300 having multi wipes contact points. Wipe dispenser 1300 is a canister wipes dispenser and includes a container 1302 having a cap 1310. Cap 1310 has a closure 1311 that secures cap 1310 to container 1302. In this exemplary embodiment, closure 1311 includes one or more optional apertures 1312 for aiding in securing the dispenser to a wall bracket. Cap 1310 incudes a first wipes engagement member 1350 and a second wipes engagement member 1320. First wipes engagement member 1350 is preferably made of an elastomeric material as described above, with respect the first wipes engagement members, and preferably is made of a material such as, for example, silicone. First wipes engagement member includes an opening 1392. First wipes engagement member 1350 is a resilient material that may be stretched and returns to its original shape. Thus, a user may push a wipe up through opening 1392 and opening 1392 will stretch allowing the end of the wipe and at least a portion of the user's finger to pass the opening 1392. Cap 1310 includes an annular projection 1600. First wipes engagement member 1350 is located within the annular projection 1600, and in this exemplary embodiment may be welded to the cap 1310 and or the annular projection 1600. First wipes engagement member 1350 is made of a resilient material and the opening 1392 is sized so that a wipe (not shown), or portion of a wipe, extending up through the opening will be held in place and the wipe will not fall back into the container 1302.

Second wipes engagement member 1320 is a grip member that includes an opening 1321 that allows a wipe to be pulled into the grip member 1320. In this exemplary embodiment, grip member 1320 includes one or more optional fingers 1322 and one or more slots 1323. In some embodiments, first wipes engagement member 1350 and second wipes engagement member 1320 are made of different materials. In some embodiments, second wipes engagement member 1320 is more ridged than first wipes engagement member 1350. In some embodiments, second wipes engagement member 1320 is made of a thermoplastic material and first wipes engagement member 1350 is made of a rubber type material, such as, for example, silicone.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. For example, the fluid retaining member may be separate from the dome swivel nozzle. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. A wipes dispenser comprising:

a container;

the container having an opening;

a cap;

a first wipe engagement member;

the first wipes engagement member being made of flexible resilient elastomeric membrane having a flat surface and having an opening therethrough;

the first wipes engagement member is configured to provide sufficient force on a wipe to prevent the wipe from falling back into the container;

the first wipe engagement member having a continuous circular opening in the elastomeric membrane, wherein the continuous circular opening readily stretches from a first diameter to a second diameter to allow a wipe and a person's finger to be pushed through;

wherein the first wipe engagement member does not separate a leading wipe from a trailing wipe;

a second wipes engagement member;

the second wipes engagement member located away from the first wipes engagement member;

the second wipes engagement member having a pull through portion and a grip portion; and the second wipes engagement member made of a material that is a different material and a more rigid material than the material that the flexible resilient elastomeric membrane of the first wipes engagement member.

2. The wipes dispenser of claim 1 further comprising an access point located between the first wipes engagement member and the second wipes engagement member; wherein the access point is configured to allow a user to grip a lead edge of a wipe as the wipe is threaded through the first wipes engagement member.

3. The wipes dispenser of claim 1 wherein the second engagement member comprises two or more fingers.

4. The wipes dispenser of claim 1 wherein the second wipe engagement member is located above the first wipe engagement member.

5. The wipes dispenser of claim 1 wherein the cap has an aperture therethrough and the flexible resilient elastomeric engagement member at least partially covers the opening.

6. The wipes dispenser of claim 1 wherein the second wipes engagement member is offset from the opening in the first wipes engagement member.

7. The wipes dispenser of claim 1 wherein the first wipes engagement member is configured to engage a wipe to close off the opening in the elastomeric material and reduce drying out of wipes in the container.

8. A wipes dispenser comprising:

a container;

the container having an opening;

a cap;

a first wipe engagement member;

the first wipes engagement member having a continuous circular opening therethrough;

the first wipes engagement member comprising a flat elastomeric membrane;

wherein the first wipe engagement member does not separate a leading wipe from a trailing wipe;

a second wipes engagement member;

the second wipes engagement member comprising a second material;

wherein the continuous circular opening in the first wipes engagement member is formed in a the flexible elastomeric membrane and the continuous circular opening stretches from a first diameter to a second diameter to allow a wipe and a person's finger to be pushed through;

the second engagement member located away from the first engagement member; and wherein the second material is different than the first engagement material and wherein the second material is harder than the first material.

9. The wipes dispenser of claim 8 wherein the second engagement member comprises a gripper.

10. A wipes dispenser comprising:

a container;

a cap on the container;

an opening in the cap;

a fall back prevention member proximate the opening;

the fall back prevention member is a flat membrane made of a first material which is an elastomeric material;

the fall back prevention member having a continuous circular opening therethrough for receiving a wipe;

wherein the continuous circular opening stretches from a first diameter to a second diameter to allow a wipe and a person's finger to be pushed through;

wherein the fall back prevention member does not separate a leading wipe from a trailing wipe;

a grip member located away from the fall back prevention member;

the grip member made of a second material that is a different material than the first material and the second material is more rigid then the first material and wherein the grip member contacts wipes with sufficient force that a first wipe connected to a second wipe along a perforation line will separate from the second wipe when the grip member engages the second wipe.

11. The wipes dispenser of claim 10 wherein the elastomeric material comprises silicone.

12. The wipes dispenser of claim 10 wherein the second material is a plastic material.

* * * * *